US012484701B2

(12) United States Patent
Merey

(10) Patent No.: US 12,484,701 B2
(45) Date of Patent: Dec. 2, 2025

(54) COLLAPSIBLE STEP STOOL

(71) Applicant: Thomas G.B. Merey, Port Hope (CA)

(72) Inventor: Thomas G.B. Merey, Port Hope (CA)

( * ) Notice: Subject to any disclaimer, the term of this patent is extended or adjusted under 35 U.S.C. 154(b) by 168 days.

(21) Appl. No.: 18/376,011

(22) Filed: Oct. 3, 2023

(65) Prior Publication Data

US 2024/0108144 A1 Apr. 4, 2024

Related U.S. Application Data

(60) Provisional application No. 63/412,701, filed on Oct. 3, 2022.

(51) Int. Cl.
*A47C 12/00* (2006.01)
*A47C 4/04* (2006.01)

(52) U.S. Cl.
CPC ..... *A47C 12/00* (2013.01); *A47C 4/045* (2013.01)

(58) Field of Classification Search
CPC ..... A47C 12/00; A47C 12/02; A47C 4/045; E06C 1/3835
See application file for complete search history.

(56) References Cited

U.S. PATENT DOCUMENTS

| | | | | |
|---|---|---|---|---|
| 1,125,194 | A | 1/1915 | Sigmund | |
| 1,811,674 | A | 6/1931 | Longley | |
| 2,043,669 | A | 6/1936 | Liska | |
| 3,346,317 | A | 10/1967 | Peggs | |
| 3,564,790 | A | 2/1971 | Rehfeld | |
| 4,533,179 | A | 8/1985 | Nichols et al. | |
| 4,630,861 | A | 12/1986 | Henschel | |
| 5,562,050 | A | 10/1996 | Colquhoun | |
| D460,566 | S | 7/2002 | Henschel et al. | |
| 6,926,119 | B1 * | 8/2005 | Schrock | E06C 1/393 182/152 |
| D566,856 | S | 4/2008 | Eveleth | |
| D579,680 | S | 11/2008 | Emert | |
| D586,923 | S | 2/2009 | Eveleth | |
| D644,032 | S | 8/2011 | Eveleth | |
| 8,701,830 | B2 * | 4/2014 | Merey | E06C 1/383 108/92 |
| D756,574 | S | 5/2016 | Jakubowski et al. | |
| 9,675,830 | B2 | 6/2017 | Holland et al. | |
| 9,832,968 | B2 | 12/2017 | Jakubowski et al. | |
| D900,493 | S | 11/2020 | Mahiques | |
| 10,993,548 | B2 | 5/2021 | Moriarty | |
| 11,903,486 | B2 * | 2/2024 | Dokhanian | A47C 4/045 |
| D1,055,315 | S * | 12/2024 | Sun | D6/350 |

(Continued)

FOREIGN PATENT DOCUMENTS

| | | | |
|---|---|---|---|
| DE | 102019125221 | A1 | 3/2021 |
| WO | WO-2015031632 | A1 | 3/2015 |

*Primary Examiner* — Milton Nelson, Jr.
(74) *Attorney, Agent, or Firm* — PERRY + CURRIER INC.

(57) ABSTRACT

A collapsible step stool includes step-shaped side panels and folding tread panels. Each folding tread panel is pivot connected to respective top edges of the step-shaped side panels to define a step when unfolded. Each folding tread panel includes a hinge to enable it to fold. A support post is connected to the hinges of adjacent folding tread panels. The support post rests on a surface and supports the upper one of the folding tread panels when the step stool is unfolded. The support post synchronizes the folding of the tread panels when collapsing the step stool.

13 Claims, 10 Drawing Sheets

(56) References Cited

U.S. PATENT DOCUMENTS

| | | | | |
|---|---|---|---|---|
| 2008/0078309 | A1 | 4/2008 | Eveleth | |
| 2013/0192925 | A1 | 8/2013 | Chitturi et al. | |
| 2015/0313355 | A1 | 11/2015 | Holmes et al. | |
| 2015/0320218 | A1 | 11/2015 | Taylor | |
| 2022/0369820 | A1* | 11/2022 | Zhu | E06C 1/393 |
| 2023/0320490 | A1* | 10/2023 | Ito | A47C 9/025 297/183.5 |

* cited by examiner

100

COLLAPSIBLE STEP STOOL

CROSS-REFERENCE TO RELATED APPLICATIONS

This application claims the benefit of U.S. provisional patent app. no. 63/412,701, filed Oct. 3, 2022, which is incorporated herein by reference.

FIELD

This disclosure relates generally to step stools, and more specifically to lightweight, collapsible step stools that are able to support a heavy load.

BACKGROUND

Folding step stools with high load bearing capacity tend to require time consuming two hand operations to open or fold, and are often bulky and take up considerable space when folded. There is a need for a multi-step stool that is capable of folding or unfolding instantly using just one hand, and that can be stored in a compact space.

SUMMARY

According to an aspect of this disclosure, a step stool includes a pair of step-shaped side panels and a folding front panel. The folding front panel is pivot connected to each of the step-shaped side panels. The step stool further includes folding tread panels. Each folding tread panel is pivot connected to respective top edges of the pair of step-shaped side panels to define a step when unfolded. Each folding tread panel includes a hinge to enable each folding tread panel to fold. The step stool further includes a support post connected to the hinges of an upper folding tread panel and a lower folding tread panel of the folding tread panels. The support post is to rest on a surface and support the upper tread panel of the folding tread panels when the step stool is unfolded. The support post synchronizes folding of the upper folding tread panel and the lower folding tread panel when folding the step stool.

According to another aspect of this disclosure, a step stool includes a pair of step-shaped side panels, a folding front panel pivot connected to front edges of each of the step-shaped side panels, and a folding rear panel pivot connected to rear edges of each of the step-shaped side panels. The step stool further includes a top folding tread panel, a middle folding tread panel, and a bottom folding tread panel. Each of the top folding tread panel, the middle folding tread panel, and the bottom folding tread panel are pivot connected to the pair of step-shaped side panels to define a step when unfolded. Each of the top folding tread panel, the middle folding tread panel, and the bottom folding tread panel includes a hinge to enable folding. The step stool further includes a handle connected at the hinge of the middle folding tread panel. The step stool further includes a first support post including a first upper opening and a first lower opening, the first lower opening being longer than the first upper opening. The first support post is pivot connected to the hinge of the top folding tread panel at the first upper opening and slot connected to the hinge of the middle folding tread panel at the first lower opening. The step stool further includes a second support post including a second upper opening and a second lower opening. The second lower opening is longer than the second upper opening. The second support post is pivot connected to the hinge of the middle folding tread panel at the second upper opening and slot connected to the hinge of the bottom folding tread panel at the second lower opening. The first support post is to rest on a surface and support the upper tread panel and the second support post is to rest on the surface and support the middle tread panel when the step stool is unfolded. The first and second support posts enable synchronized folding of the connected top folding tread panel, middle folding tread panel, and bottom folding tread panel when folding the step stool.

BRIEF DESCRIPTION OF DRAWINGS

Implementations are described with reference to the following figures, in which.

DETAILED DESCRIPTION

The collapsible step stools presented in this disclosure offer lightweight, mobile step stools that are able to support a high weight capacity. There is a need for a step stool that enables a user to quickly collapse or fold the stool with one hand for quick transfer from location to location, as well as a need for the lightweight step stool to be able to support a heavy load without locking required for safe operation.

An example embodiment of the collapsible step stool includes a pair of side panels and a plurality of tread panels that connect to the edges of the side panels to form steps. The collapsible step stool also includes front and back panels for added support. The front and back panels are also connectable to the side panels. The top tread panel is hinge connected to the back panel, and the bottom tread panel is hinge connected to the front panel, The collapsible step stool also includes as well as at least two support rods connected to the tread panels to support the step stool.

Figure 1:
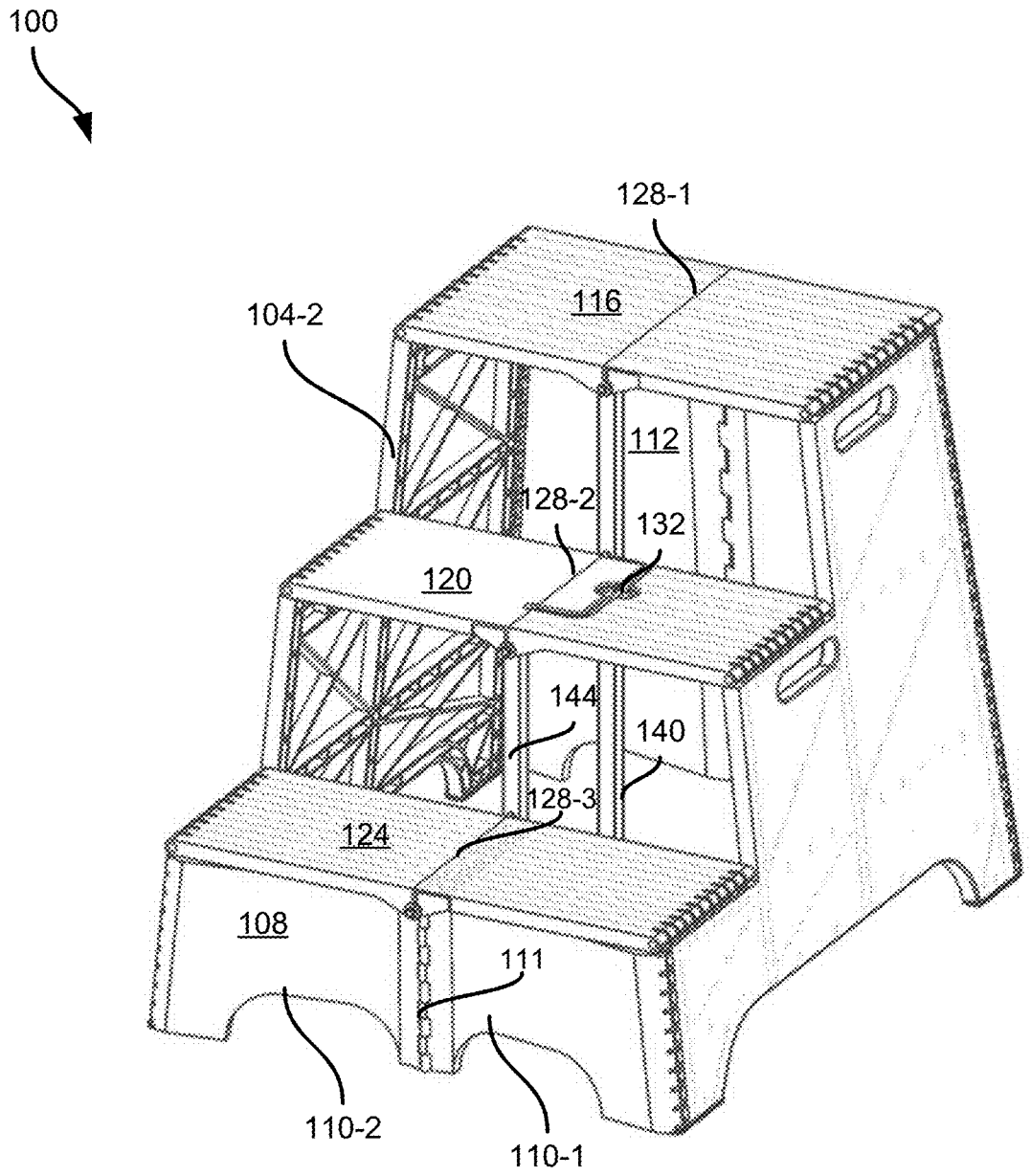
FIG. 1 is a perspective view of a collapsible step stool comprising three steps in an unfolded configuration.

FIG. 1 shows an example embodiment of collapsible step stool 100, in an unfolded configuration (also referred to as step stool 100 or stool 100). Step stool 100 comprises two side panels 104-1 and 104-2. (Hereafter, side panels 104-1 and 104-2 are referred to collectively as side panels 104 and generically as panels 104. This nomenclature is used elsewhere herein). The side panels are step shaped. The steps may be square shaped steps, rectangular shaped steps, or any other shape that would support the structure to enable weight bearing capacity. The step shape should be around 90 degrees in each corner to provide step stool 100 with good support.

Figure 2:
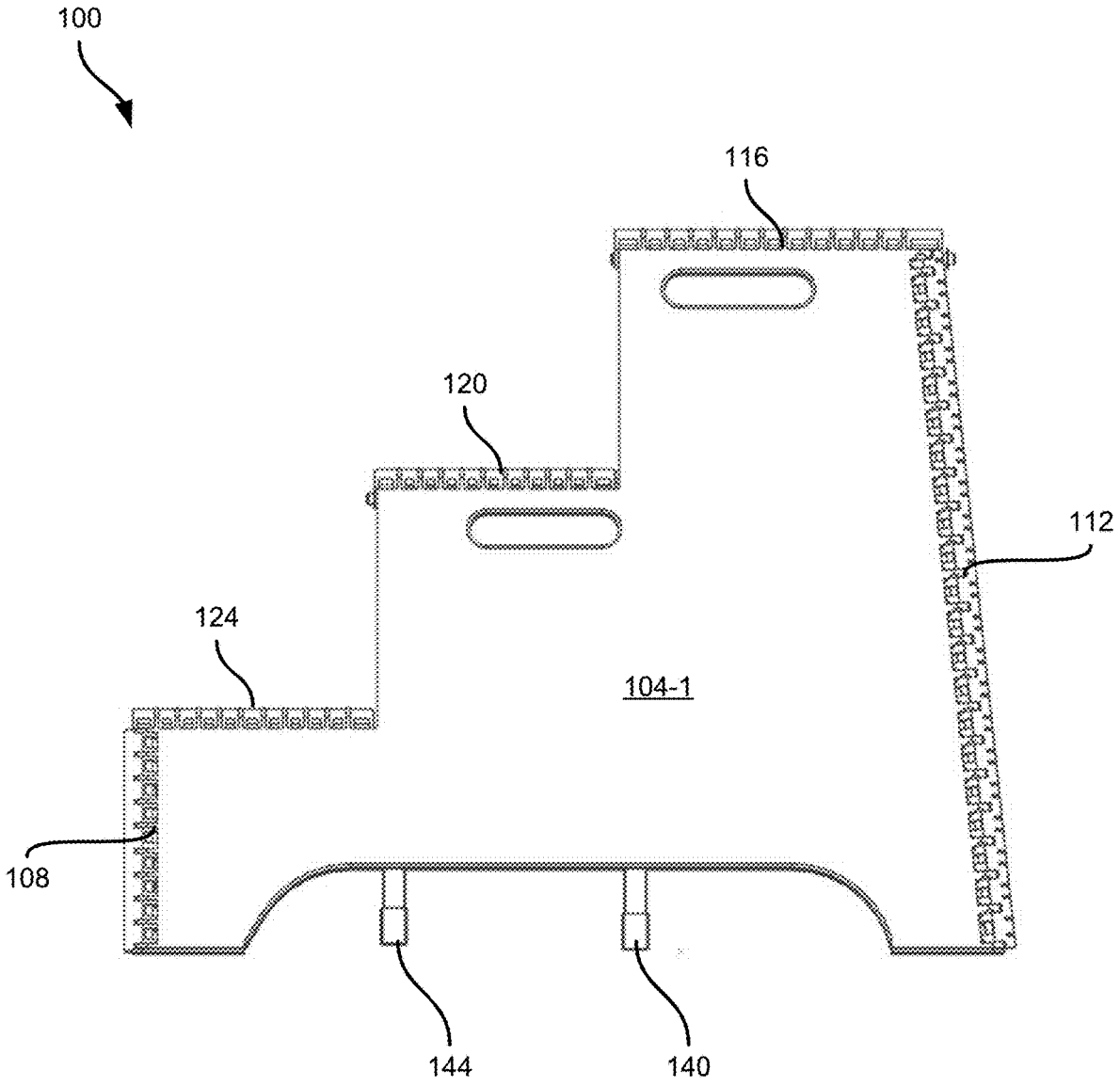
FIG. 2 is a side view of the collapsible step stool of FIG. 1.

The step shape can be seen clearly in FIG. 2, where a side view of the unfolded step stool 100 is shown, and more specifically, a side view of side panel 104-1 is shown. Side panels 104 may lay flat on the ground or may comprise of a cut out on each side as can be seen in FIG. 2. The curved cut out on the bottom of side panels 104 provide added support at the corners of step stool 100 to add stability to step stool 100 and avoid shakiness when weight is applied to step stool 100. Side panels 104 may also comprise of cut-outs that are used for carrying step stool 100.

Referring back to FIG. 1, step stool 100 further comprises a folding front panel 108, which pivot connects to the edges of side panels 104. The pivot connection that connects front panel 108 to the edges of side panel 104 may be a hinge, or any moving linkage mechanism that allows front panel 108 and side panels 104 to pivot on a single point on each side of the front panel. This pivot connection facilitates the folding of step stool 100 (which will be discussed in further detail with reference to FIGS. 5 and 6, below).

Figure 3:
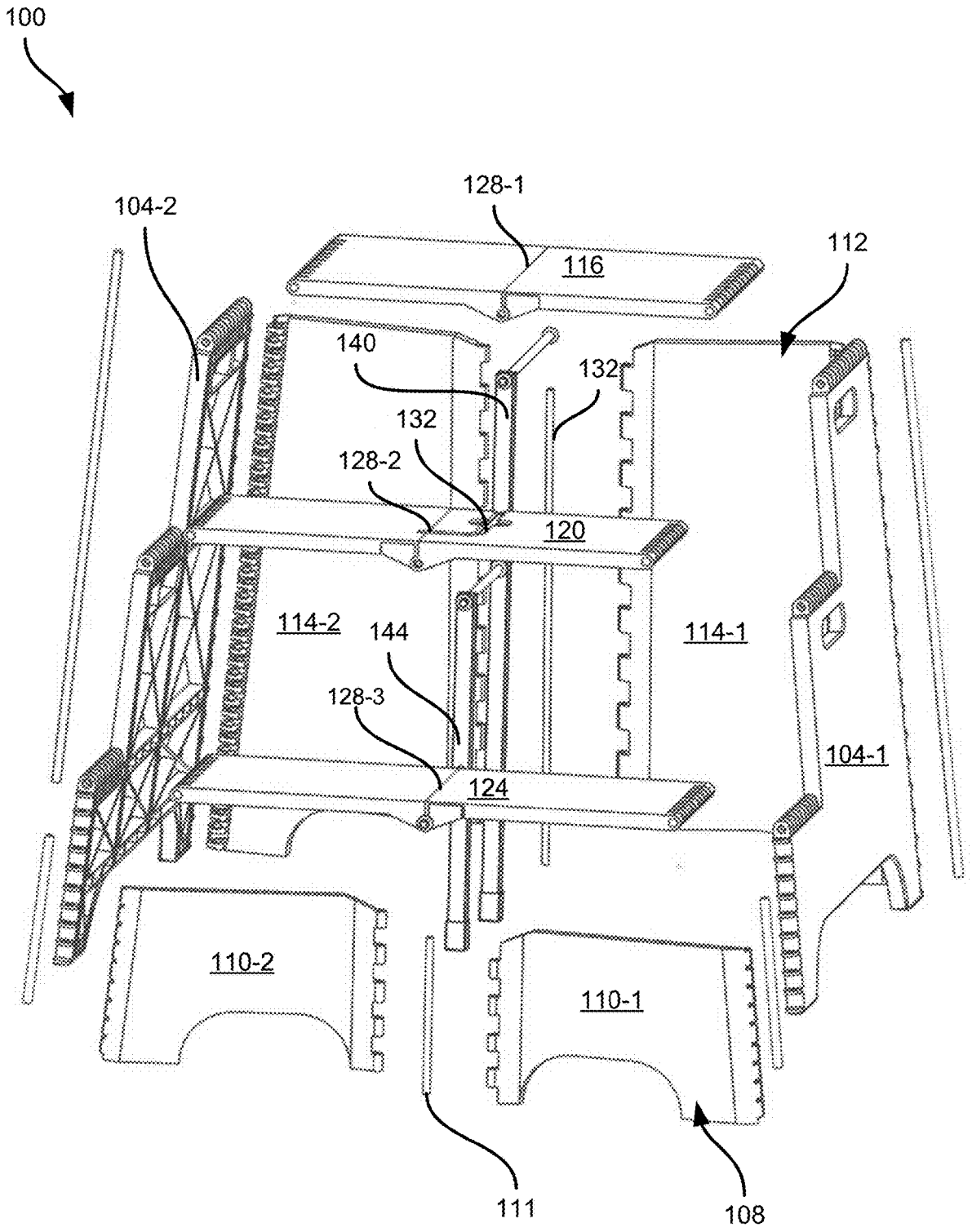
FIG. 3 is an exploded front view of the collapsible step stool of FIG. 1.

Front panel 108 comprises two smaller subpanels 110, as can be seen in FIG. 3, which depicts an exploded view of step stool 100. Subpanels 110 connect to each other by a folding connector 111. Folding connector 111 may be a hinge similar to the pivot connection that connects side panels 104 to front panel 108. The configuration of subpanels 110 and folding connector 111 in this manner enables front panel 108 to fold in the middle when step stool 100 is in the folded (or collapsed) configuration. Front panel 108 may be rectangular in shape, or it may be any shape that is able to support a weight bearing capacity while connecting to side panels 104. Front panel 108 may also comprise a semi-circular cut-out on each subpanel 110 which serve the same purpose as the cut-outs discussed in reference to side panels 104 above.

Figure 4:
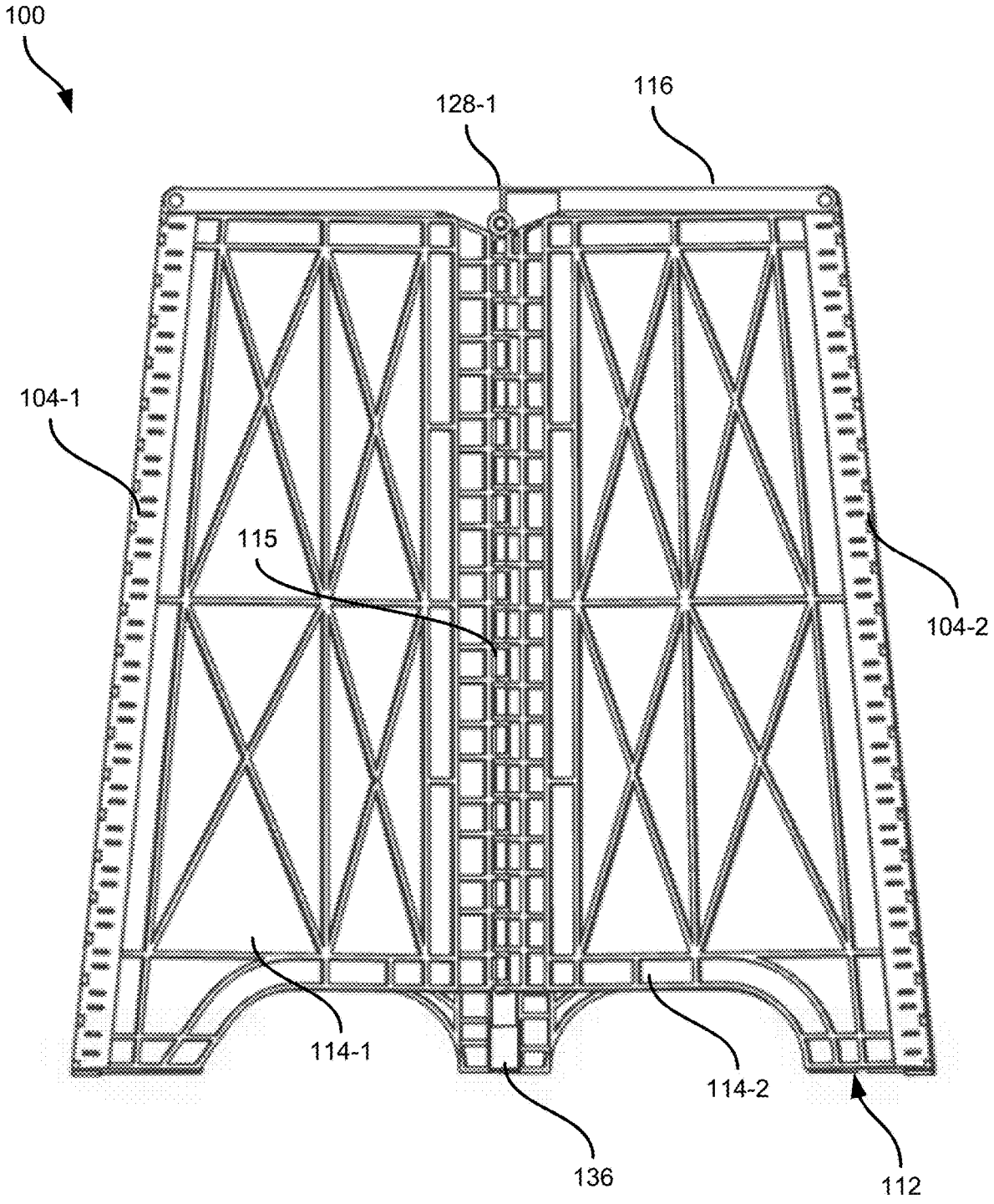
FIG. 4 is a rear view of the collapsible step stool of FIG. 1.

Referring now to FIG. 4, a rear view of unfolded step stool 100 is shown. As can be seen in FIG. 4, step stool 100 further comprises a rear panel 112 that pivot connects to the rear edges of side panels 104. Similar to front panel 108, rear panel 112 comprises two subpanels 114 that connect via a folding connector 115. Folding connector 115 may be a hinge similar to the pivot connection that connects side panels 104 to front panel 108. The configuration of subpanels 114 and folding connector 112 in this manner enables rear panel 112 to fold in the middle when step stool 100 is in the folded (or collapsed) configuration. Rear panel 112 may be rectangular in shape, or it may be any shape that is able to support a weight bearing capacity while connecting to side panels 104. Rear panel 112 may also comprise a semi-circular cut-out on each subpanel 114 which serve the same purpose as the cut-outs discussed in reference to side panels 104 and front panel 108 above.

Figure 5:
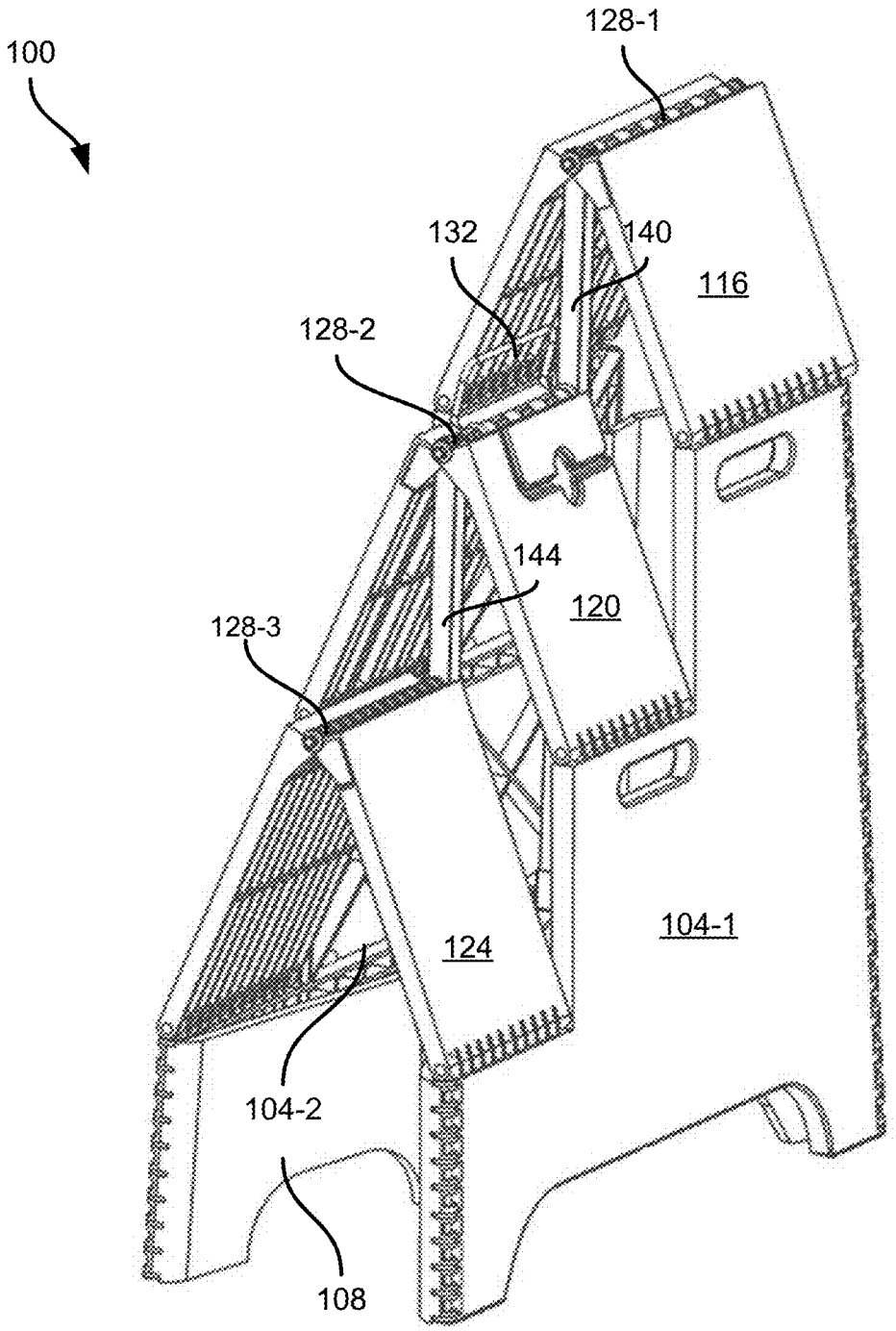
FIG. 5 is a perspective view of the collapsible step stool of FIG. 1 transitioning between the folded (or collapsed) configuration to the unfolded configuration.
Figure 6:
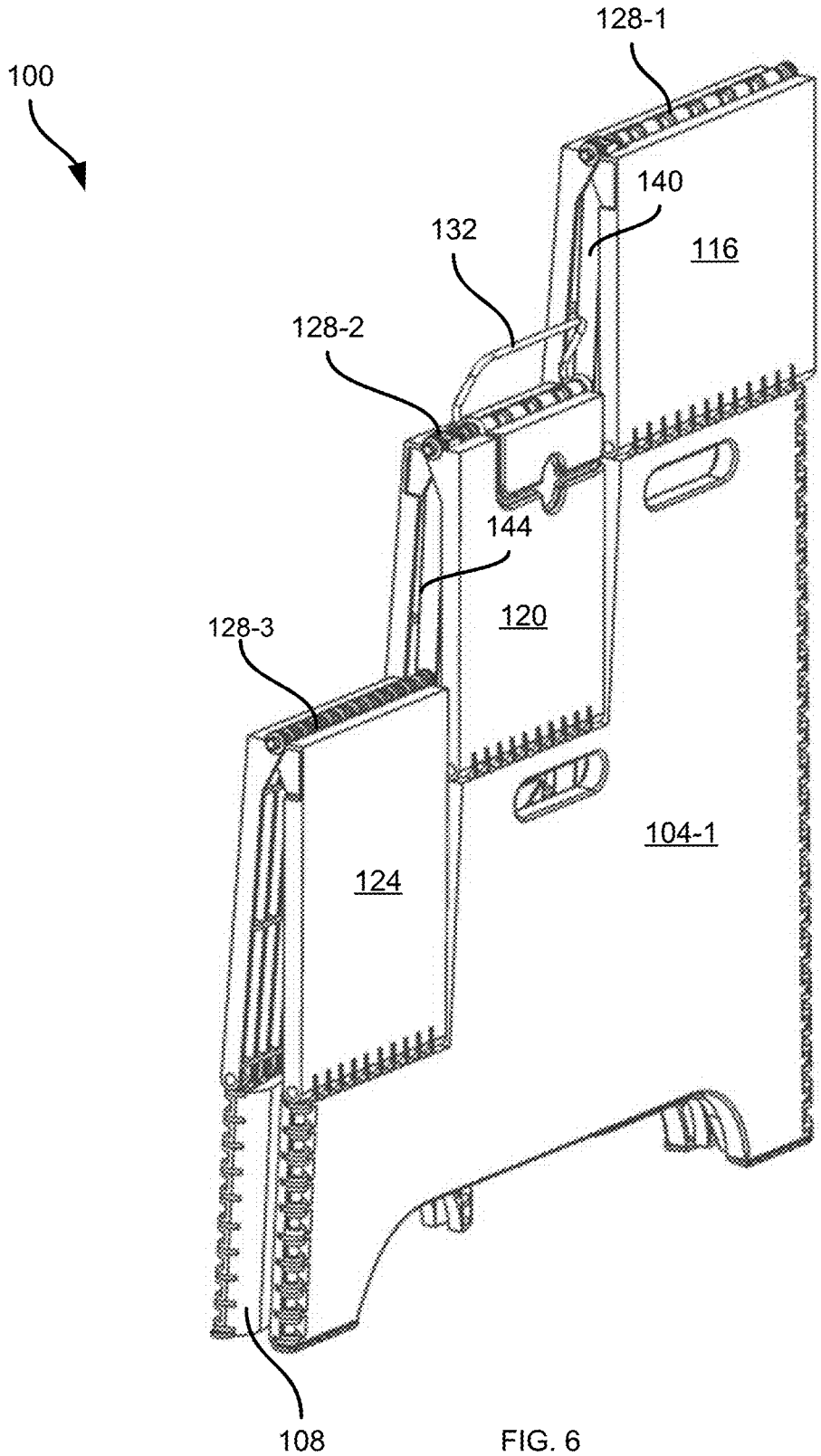
FIG. 6 is a perspective view of the collapsible step stool of FIG. 1 in the folded configuration.

Referring now back to FIG. 1, it can be seen that step stool 100 further comprises a folding top tread panel 116, a folding middle tread panel 120, and a folding bottom tread panel 124. Top tread panel 116 may also be referred to as upper tread panel 116, and bottom tread panel may also be referred to as lower tread panel 124. Each of top tread panel 116, middle tread panel 120, and bottom tread panel 124 include a hinge 128. Hinge 128 allows each of top tread panel 116, middle tread panel 120, and bottom tread panel 124 to fold simultaneously and quickly through the assistance of gravity. The folding motion is depicted through in FIG. 5 where the transitional configuration of step stool 100 as it is being collapsed is depicted, and in FIG. 6, where the fully collapsed step stool 100 is depicted. As can be seen in FIG. 5 and FIG. 6, side panels 104 are configured to move towards the center of step stool 100 until they eventually meet each other. Hinges 128 on each tread panels 116, 120 and 124 are configured to enable each of top tread panel 116, middle tread panel 120 and bottom tread panel 124 to fold downward. In other words, hinges 128 will move in an upward motion, while the top tread panel 116, middle tread panel 120 and bottom tread panel 124 will rotate in a downward motion. Hinge 128 may be a butterfly hinge, a concealed hinge, a friction hinge, or any other type of hinge that will enable the folding of step stool 100 in this manner.

Each of top tread panel 116, middle tread panel 120 and bottom tread panel 124 are pivot connected on either side to each side panel 104. The configuration of top tread panel 116, middle tread panel 120, and bottom tread panel 124 along with the side panels 104 defines a step when step stool 100 is in the unfolded configuration. Each of top tread panel 116, middle tread panel 120, and bottom tread panel 124 may include corrugation or furrowing for non-slip support. Top tread panel 116 is generally larger than middle tread panel 120 and bottom tread panel 124, however, it may also be the same size. When top panel 116 is larger than middle tread panel 120 and bottom tread panel 124, there is allowed a clearance for large feet to stand in comfort while standing on middle tread panel 120 bottom tread panel 124, due to the fact that larger shoes are able to protrude out into the cavity clearance. In such a configuration, the middle and bottom steps defined by middle tread panel 120 and bottom tread panel 124 are more than just a way to reach top tread panel 116, but rather act as working platforms.

Middle tread panel 120 comprises a handle 132 that is connected at the hinge 128-2 of tread panel 120. Handle 132 is generally located on middle tread panel 120, but it also may be located on any other tread panel 116 or 124. Handle 132 should be at a distance (when handle 132 is lifted upwards) that is far enough from hinge 128-2 so as to not come into contact when hinge 128-2 when it is being folded, in order to allow a full range of motion to hinge 128-2. Handle 132 allows the user to lift step stool 100 in order to allow step stool 100 to fold quickly and easily with gravity assistance, with a single hand. The location of handle 132 also coincides with the center of gravity of step stool 100, so that when lifted by handle 132, step stool 100 would hang straight. Middle panel 120 comprises a cut out to enable handle 132 to stay flush with middle panel 120 when the handle is not in use. This cut out can be seen clearly in FIGS. 5 and 6. The flush configuration of handle 132 allows the surface of middle panel 120 to provide unobstructed support to a user when they are stepping on the step defined by middle tread panel 120.

Referring now back to FIG. 1, step stool 100 further comprises a first support post 140, and a second support post 144. First support post 140 is generally longer than second support post 144 to allow first support post 140 to reach top tread panel 116, while second support post 144 generally is configured to reach middle tread panel 120. First support post 140 is configured to rest on a surface and support top tread panel 116 when step stool 100 is in the unfolded configuration and second support post 144 is configured to rest on the surface and support middle tread panel 116.

First support post 140 and second support post 144 are configured in a manner to enable the synchronized folding of each of top tread panel 116, middle tread panel 120, and bottom tread panel 124. First support post 140 and second support post 144 further provide load support at the center of each of top tread panel 116, middle tread panel 120, and bottom tread panel 124. Additionally, the support posts 140 and 144 tie together all three steps that are defined by top tread panel 116, middle tread panel 120, and bottom tread panel 124 in a manner that allows step stool 100, when transitioning to a folded configuration, to fold without interference of the tread panels in order to achieve a fully flat collapsed configuration. The use of first support post 140 and second support post 144 instead of support walls allows the increased support for larger feet to be able to move inwards into the cavity clearance of step stool 100.

Figure 7:
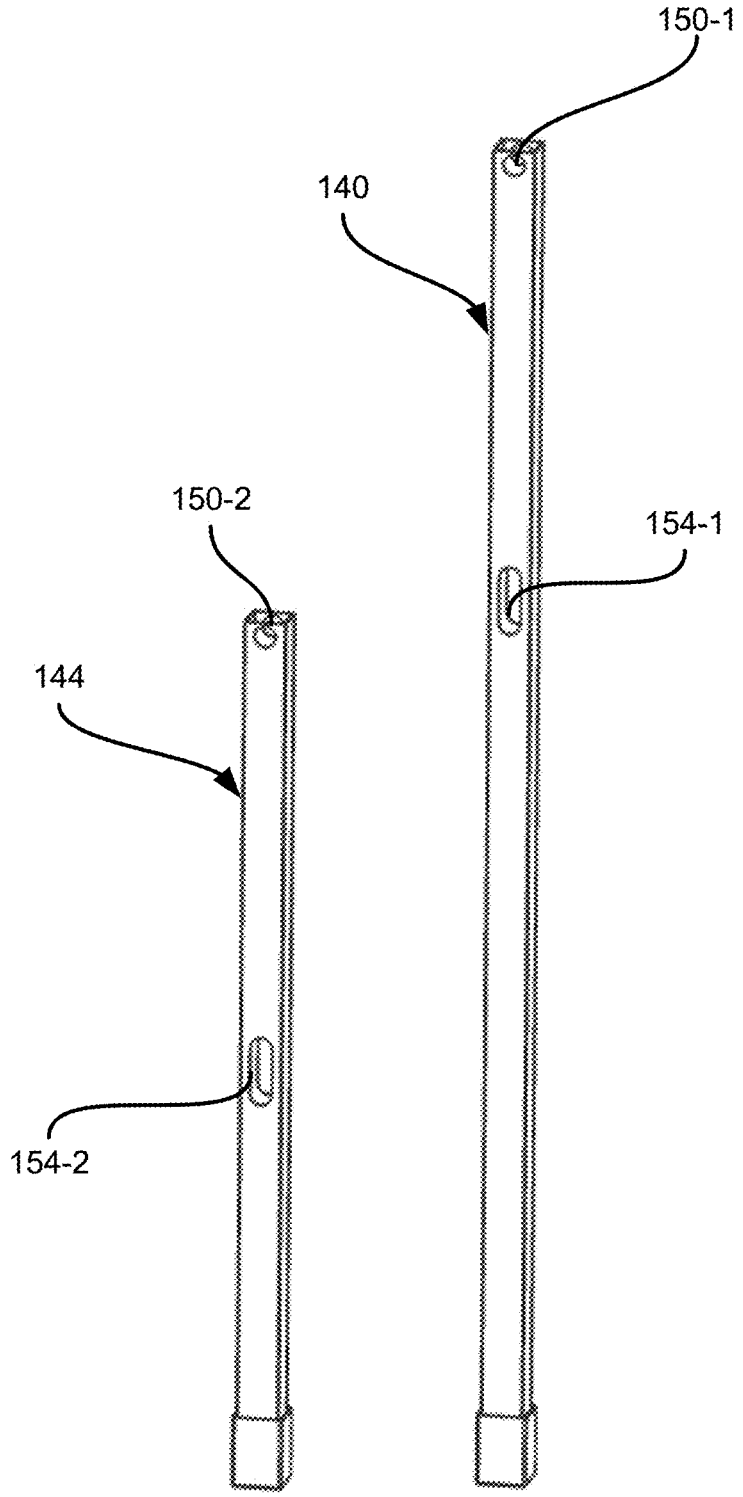
FIG. 7 is a front view of the support posts.

As can be seen in FIG. 7, First support post 140 comprises a first upper opening 150-1 and a first lower opening 154-1. The first lower opening is longer than the first upper opening. Second support post 144 comprises a second upper opening 150-2 and a second lower opening 154-2. The second lower opening 150-1 is also longer than the second upper opening 154-2. First support post 140 is pivot connected to the hinge 128-1 of top tread panel 116, and slot connected to the hinge 128-2 of middle tread panel 120. Second support post 140 is pivot connected to hinge 128-2 of middle tread panel 120, and slot connected to hinge 128-3 of bottom tread panel 124. The pivot connection may be a pin in a complementary hole, and the slot connection may be a pin in a complementary elongated slot.

Figure 8A:
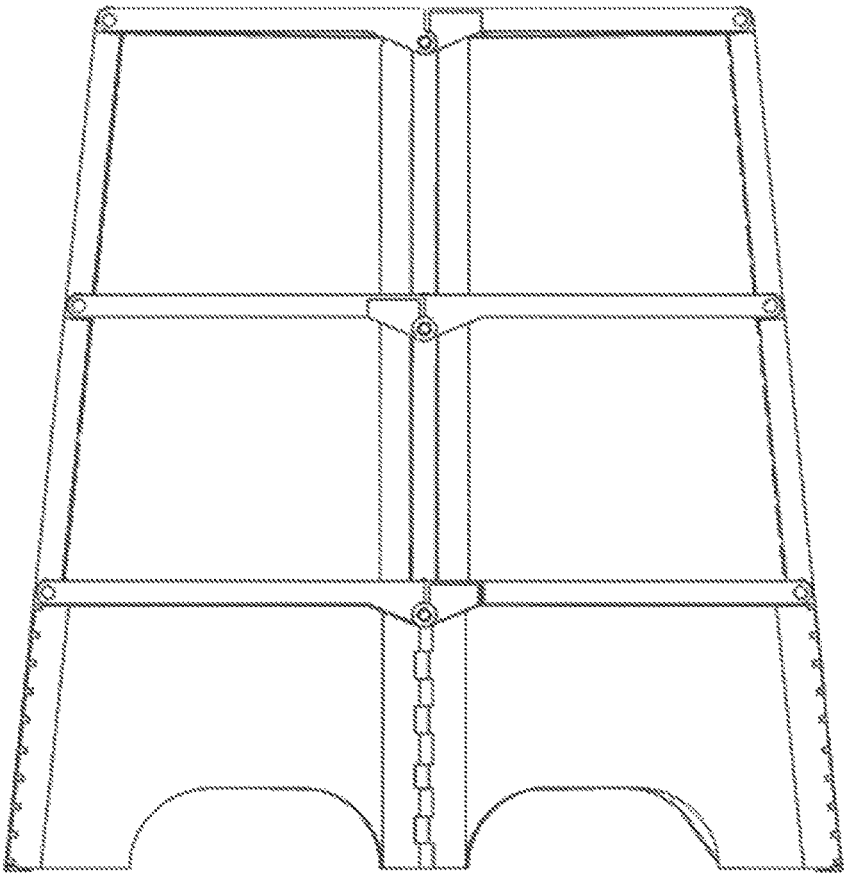
FIG. 8A is a front view of the collapsible step stool of FIG. 1 in an unfolded configuration.
Figure 8B:
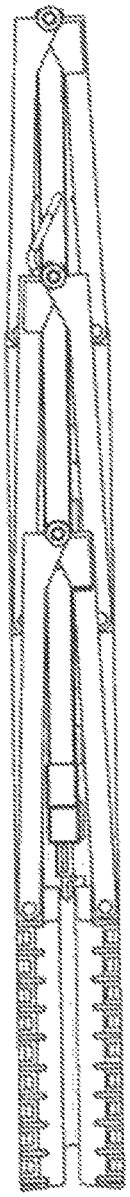
FIG. 8B is a front view of the collapsible step stool of FIG. 1 in a folded configuration.
Figure 9:
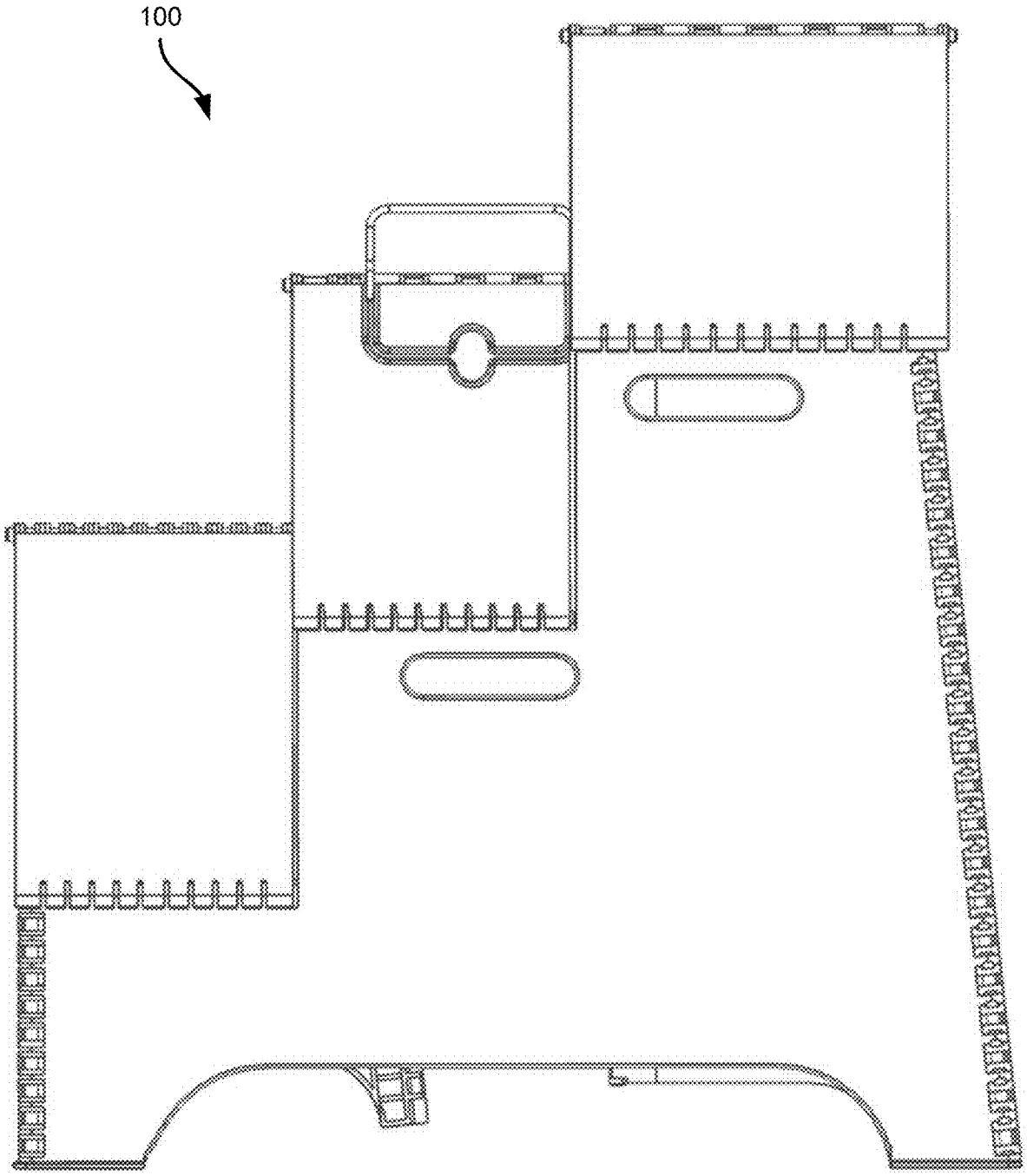
FIG. 9 is a side view of the collapsible step stool of FIG. 1 in a folded configuration.

FIG. 8A provides a front view of step stool 100 in the unfolded configuration and FIG. 8B shows the folded or collapsed configuration. FIG. 9 provides a side view of step stool 100 when it is in the folded or collapsed configuration. The panels of step stool 100, including the tread panels, side panels, and front and rear panels may be made of wood or plastic. The panels may also include structures that provide load bearing support on one side. The support posts of step stool 100 may be made of steel or other metal. The hinges may also include metal, such as metal pins that extend through plastic openings.

Figure 10:
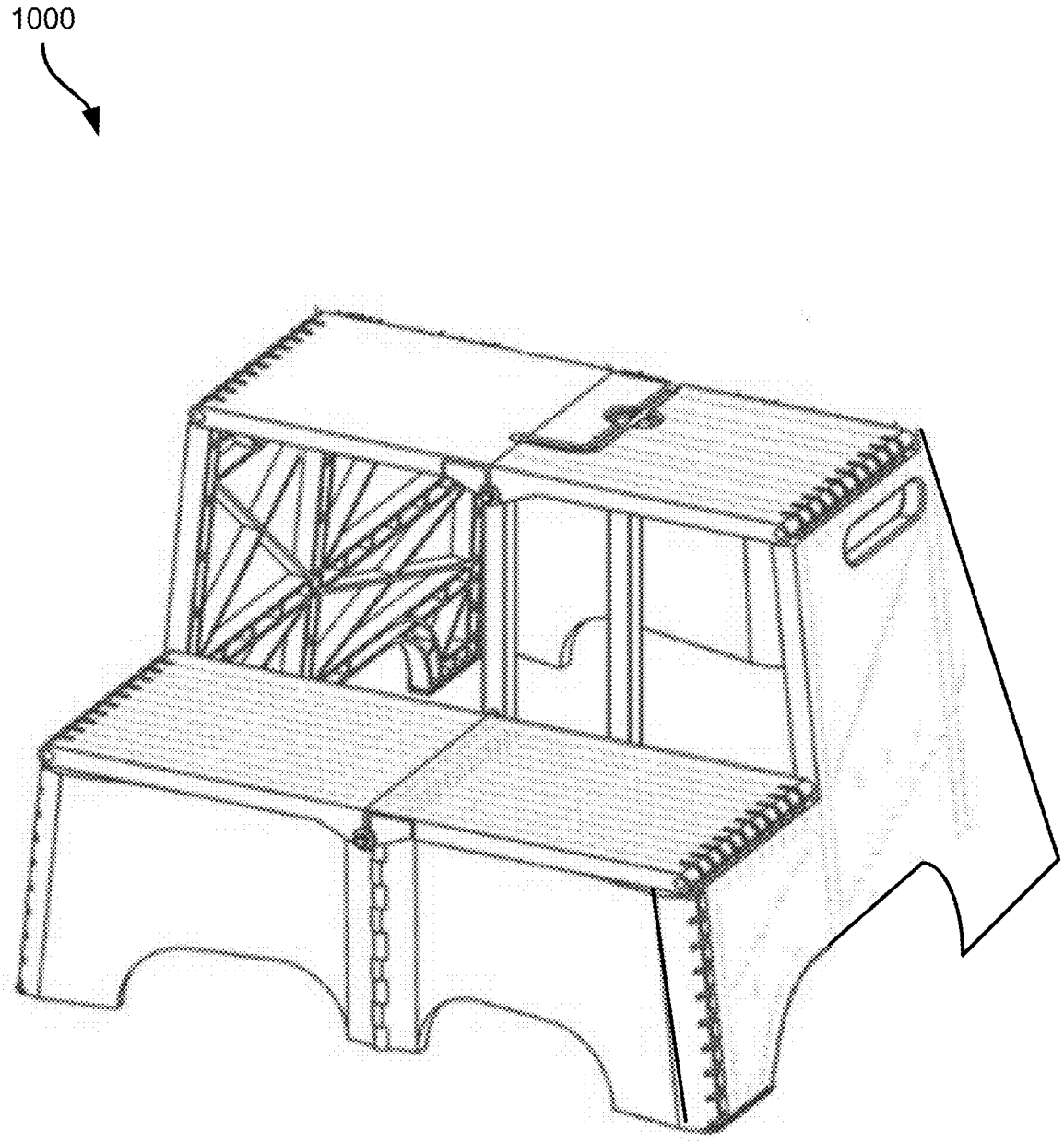
FIG. 10 is a perspective view of a collapsible step stool comprising two steps in an unfolded configuration.

The step stool may also comprise only an upper and bottom tread panel, foregoing the middle tread panel. An example of this configuration is depicted in FIG. 10, where a two-step step stool 1000 is shown. All of the elements of step stool 100 are included in step stool 1000, save for the middle tread panel.

In operation, a user may grip the handle 132 to assist in deploying step stool 100 when it is in the folded configuration. With reference to FIG. 5, gripping handle 132 allows for the folded step stool to slightly unfold with the assistance of gravity. The user may then use their hands or feet to place step stool 100 into the fully unfolded configuration. When unfolding, front panel 108 and back panel 112 are pushed outwards at hinge 111 and hinge 132 respectively, which will push side panels 104 outwards. Top tread panel 116, middle tread panel 120, and bottom tread panel 124 unfold at hinge 128 horizontally to become achieve support by first support post 140 and second support post 144, respectively.

In reference to FIG. 6, in operation to collapse step stool 100 as displayed, the user again may grip handle 132 to assist in lifting step stool 100 off the ground to allow gravity to enable step stool 100 to collapse and fold. Side panels 104 will move to the center of step stool 100 until they meet, which is achieved through the specific configuration and location of first support post 140 and second support post 144. During the collapsing operation, only one hand is needed to fold step stool 100 due to its lightweight configuration. When collapsing, front panel 108 and back panel 112 are pushed inwards at hinge 111 and hinge 132 respectively, towards the cavity of step stool 100, and top tread panel 116, middle tread panel 120, and bottom tread panel 124 collapse unfold at hinge 128 to fold vertically.

In view of the above, what is disclosed is a collapsible step stool that is stabilized by first and second support posts that reduce weight and allow for a single-handed operation to collapse the step stool, which allows users to quickly fold the step stool. The collapsible step stool is also self-folding under gravity, which allows for greater convenience. The support posts allow for a greater clearance for users with wider feet to use the step stool, as support walls that block the cavity of the step stool are not needed due to the configuration of the support posts.

The invention claimed is:

1. A step stool comprising:

a pair of step-shaped side panels;

a folding front panel, the folding front panel pivot-connected to each of the step-shaped side panels;

folding tread panels, each folding tread panel pivot-connected to respective top edges of the pair of step-shaped side panels to define a step when unfolded, each folding tread panel including a hinge to enable each folding tread panel to fold; and a support post connected to the hinges of an upper folding tread panel and a lower folding tread panel of the folding tread panels, the support post to rest on a surface and support the upper tread panel of the folding tread panels when the step stool is unfolded, the support post synchronizing folding of the upper folding tread panel and the lower folding tread panel when folding the step stool.

2. The step stool of claim 1, wherein the support post is pivot-connected at the hinge of the upper folding tread panel and slot-connected at the hinge of the lower folding tread panel.

3. The step stool of claim 1, wherein the support post comprises an upper opening and a lower opening, wherein the lower opening is longer than the upper opening.

4. The step stool of claim 1, wherein the pair of step-shaped side panels are non-folding.

5. The step stool of claim 1, wherein the folding tread panels comprise three folding tread panels including a top folding tread panel, a middle folding tread panel, and a bottom folding tread panel, wherein the upper folding tread panel is the middle folding tread panel, and the lower folding tread panel is the bottom folding tread panel.

6. The step stool of claim 5, wherein the support post is a first support post, the step stool further comprising a second support post connected to the hinge of the middle folding tread panel and the hinge of the top folding tread panel.

7. The step stool of claim 6 wherein the second support post is pivot-connected to the hinge of the middle folding tread panel and slot-connected to the hinge of the bottom folding tread panel.

8. The step stool of claim 6, wherein the second support post comprises an upper opening and a lower opening, wherein the lower opening is longer than the upper opening.

9. The step stool of claim 1, further comprising a folding rear panel pivot-connected to each of the step-shaped side panels.

10. The step stool of claim 1, further comprising a handle connected at the hinge of any of the folding tread panels, wherein lifting the step stool from the handle allows for an automatic folding movement of the step stool under force of gravity.

11. The step stool of claim 1, wherein the folding front panel supports the lower tread panel when unfolded.

12. The step stool of claim 1, wherein the each of the step-shaped side panels further comprises a handhold to enable lifting the step stool from the step-shaped side panels.

13. A step stool comprising:

a pair of step-shaped side panels;

a folding front panel pivot-connected to front edges of each of the step-shaped side panels;

a folding rear panel pivot-connected to rear edges of each of the step-shaped side panels;

a top folding tread panel, a middle folding tread panel, and a bottom folding tread panel, wherein each of the top folding tread panel, the middle folding tread panel, and the bottom folding tread panel are pivot-connected to the pair of step-shaped side panels to define a step when unfolded, wherein each of the top folding tread panel, the middle folding tread panel, and the bottom folding tread panel includes a hinge to enable folding;

a handle connected at the hinge of the middle folding tread panel;

a first support post including a first upper opening and a first lower opening, the first lower opening being longer than the first upper opening, wherein the first support post is pivot-connected to the hinge of the top folding tread panel at the first upper opening and slot-connected to the hinge of the middle folding tread panel at the first lower opening; and a second support post including a second upper opening and a second lower opening, the second lower opening being longer than the second upper opening, wherein the second support post is pivot-connected to the hinge of the middle folding tread panel at the second upper opening and slot-connected to the hinge of the bottom folding tread panel at the second lower opening;

wherein the first support post is to rest on a surface and support the upper top folding tread panel and the second support post is to rest on the surface and support the middle tread panel when the step stool is unfolded, the first and second support posts enabling synchronized folding of the connected top folding tread panel, middle folding tread panel, and bottom folding tread panel when folding the step stool.

* * * * *